US009918815B1

(12) United States Patent
Ho et al.

(10) Patent No.: US 9,918,815 B1
(45) Date of Patent: Mar. 20, 2018

(54) TOOTHBRUSH SYSTEM

(71) Applicants: Christopher Robert Ho, Katy, TX (US); Adrian Ng, Katy, TX (US); Karan Sura, Katy, TX (US)

(72) Inventors: Christopher Robert Ho, Katy, TX (US); Adrian Ng, Katy, TX (US); Karan Sura, Katy, TX (US)

( * ) Notice: Subject to any disclaimer, the term of this patent is extended or adjusted under 35 U.S.C. 154(b) by 0 days.

(21) Appl. No.: 15/276,361

(22) Filed: Sep. 26, 2016

(51) Int. Cl.
*A61C 17/22* (2006.01)
*A46B 11/00* (2006.01)

(52) U.S. Cl.
CPC ..... *A61C 17/221* (2013.01); *A61C 17/227* (2013.01); *A46B 11/001* (2013.01); *A46B 11/002* (2013.01)

(58) Field of Classification Search
CPC combination set(s) only.
See application file for complete search history.

(56) References Cited

U.S. PATENT DOCUMENTS 5,927,889 A * 7/1999 La Flower ..... A46B 11/0027 132/308
6,957,925 B1 * 10/2005 Jacobs ..... A46B 11/001 401/175
7,080,980 B2 * 7/2006 Klupt ..... A61C 17/222 15/167.1
8,287,203 B2 * 10/2012 Gruber ..... A61C 17/22 401/188 R
2006/0210352 A1 * 9/2006 Clark ..... A46B 11/0024 401/277

* cited by examiner

*Primary Examiner* — David Walczak

(57) ABSTRACT

A toothbrush system includes a handle with a chamber, a motor coupled to a plunger, a power supply, and a control switch; and a toothbrush head with a bristle unit, and an opening between the chamber rand the bristle unit.

1 Claim, 2 Drawing Sheets

TOOTHBRUSH SYSTEM

BACKGROUND

1. Field of the Invention

The present invention relates generally to hygiene systems, and more specifically, to a toothbrush system for improved convenience and reduction of toothpaste waste.

2. Description of Related Art

Hygiene systems are well known in the art and are effective means to maintain proper health. For example, FIG. 1 depicts a conventional toothbrush system 101 having a tube 103 of toothpaste and a toothbrush 105 with a handle 107 and a bristle unit 109. During use, the user (not shown), squeezes toothpaste from the tube 103 onto the bristle unit 109 and proceeds to brush their teeth.

One of the problems commonly associated with system 101 is waste and uncleanliness. For example, the user may apply excessive toothpaste to the bristle unit 109, causing waste. In addition, the user may spill or drop toothpaste during use, causing a mess.

Accordingly, although great strides have been made in the area of toothbrush systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
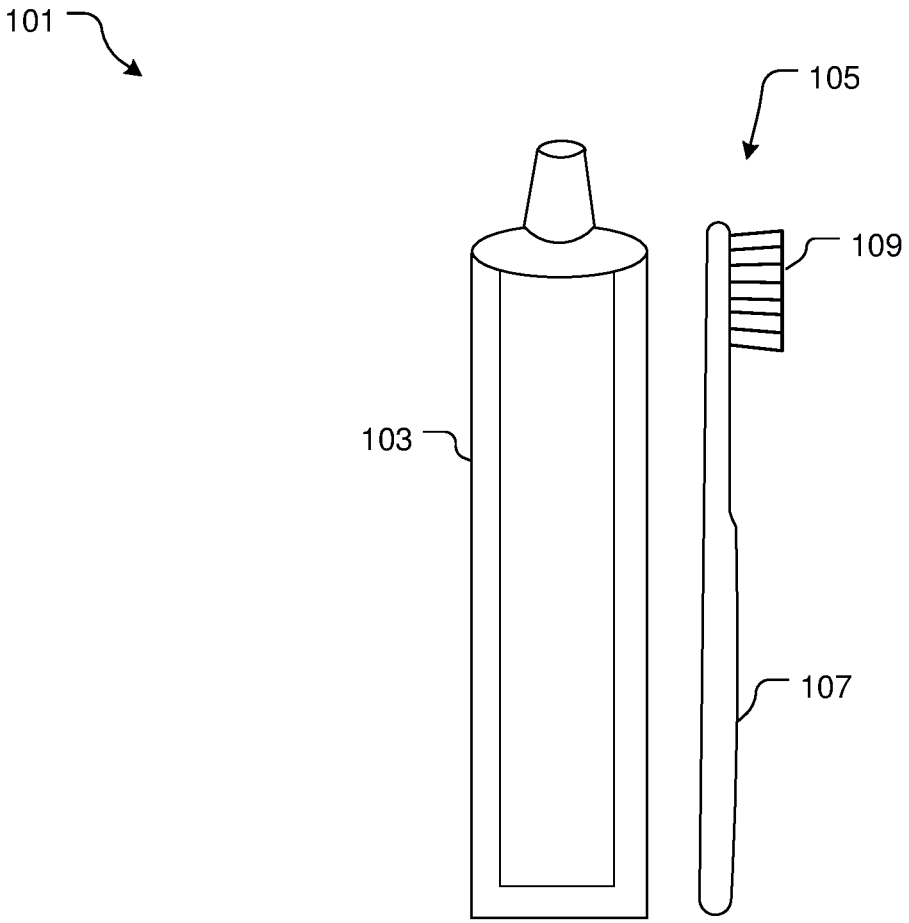
FIG. 1 (Prior Art)
FIG. 1 is a top view of a common toothbrush system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional toothbrush systems. Specifically, the present invention reduces waste and spillage of toothpaste. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
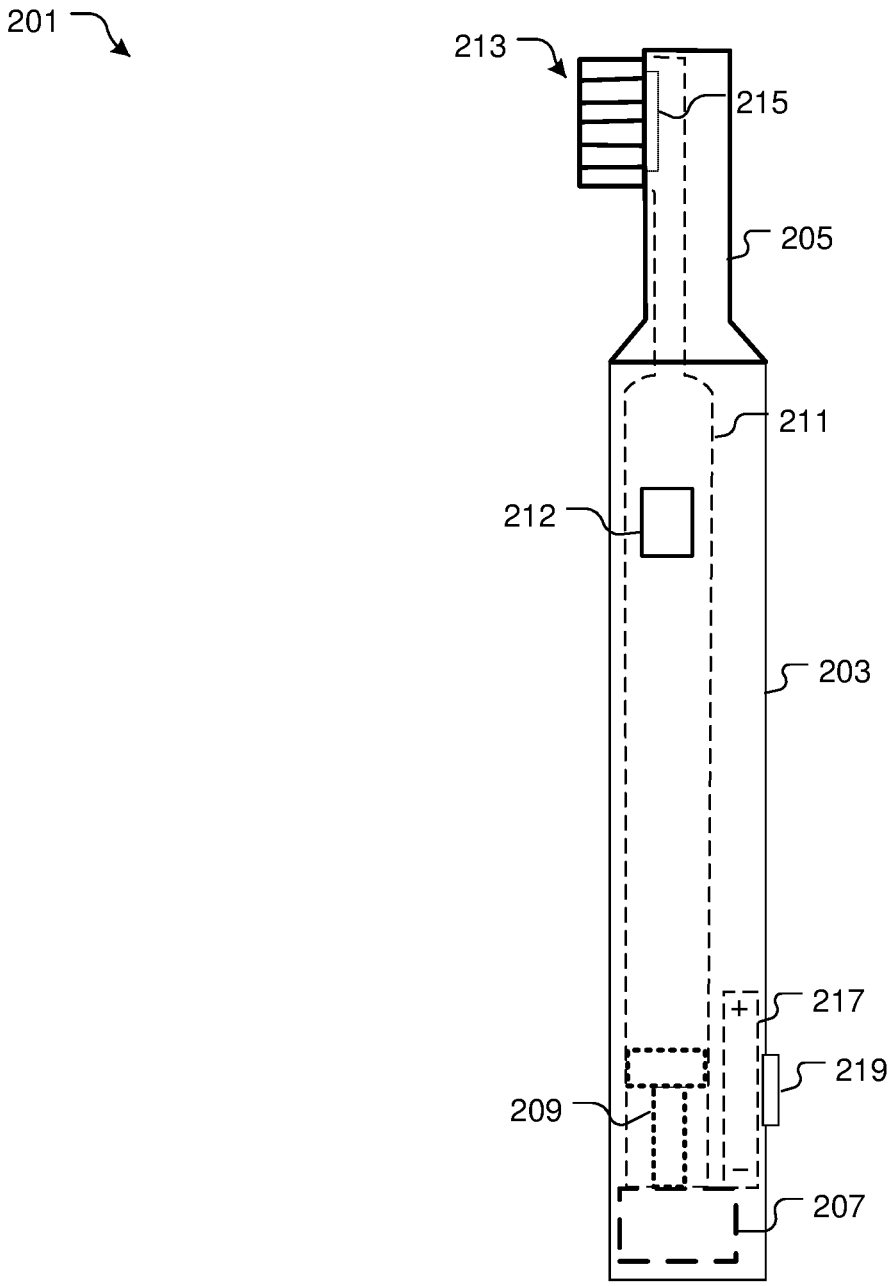
FIG. 2 is a side view of a toothbrush system in accordance with a preferred embodiment of the present application.

Referring now to the drawings wherein like reference characters identify corresponding or similar elements throughout the several views, FIG. 2 depicts a side view of a toothbrush system in accordance with a preferred embodiment of the present application. It will be appreciated that system 201 overcomes one or more of the above-listed problems commonly associated with conventional toothbrush systems.

In the contemplated embodiment, system 201 includes a handle 203 in communication with a toothbrush head 205. In the contemplated embodiment, the handle 203 houses a motor 207 attached to a plunger 209, and in communication with a chamber 211, accessed via a door 212 located on the outside of the handle 203. In addition, in the preferred embodiment, the toothbrush head 205 includes a bristle unit 213 and one or more openings 215 between the chamber 211 and the bristle unit 213. It is further contemplated that system 201 includes a rechargeable power supply 217 in the form of a battery and a control switch 219 having an automatic shut off associated therewith to shut off the motor at a predetermined setting.

During use, toothpaste (not shown) is inserted into the chamber 211 through the door 212. The user activates the motor 207 via the control switch 219, causing the plunger 209 to rise and the toothpaste to enter the bristle unit 213 through the opening 215. The user can then proceed to brush their teeth.

It should be appreciated that one of the unique features believed characteristic of the present application is the combining of toothpaste and a toothbrush into one unit, effectively reducing waste and potential for spillage of toothpaste.

It is contemplated that system 201 can be manufactured to be disposable or in the alternative to have a replaceable toothbrush head 205. It is additionally contemplated that system 201 can be altered in materials, shapes, and sizes as manufacturing, functional, and aesthetic considerations require.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A toothbrush system comprising:

a handle having a first and second opposing ends and a chamber therein for housing toothpaste;

a head positioned at the second end of the handle and having bristles on an outer surface thereof and an opening in the outer surface adjacent the bristles which is in fluid communication with said chamber, a motor adjacent the first end of the handle and positioned within the handle, a plunger in the chamber which is advanced by the motor, a power supply in the form of a battery positioned adjacent to the plunger when the plunger is in a lowermost position, a control switch adjacent the first end of the handle and positioned exteriorly of the handle such that a user may operate the control switch; the control switch having an automatic shut off associated therewith to shut off the motor at a predetermined setting, a door adjacent the second end of the handle and positioned in a side thereof such that a user may open the door to supply toothpaste to the chamber through the open door, wherein, upon activation of the motor by the control switch, the plunger advances from the lowermost position to a raised position to thereby force the toothpaste in the chamber to through the opening in the head and onto the bristles.

* * * * *